US012766594B2

(12) United States Patent
Inoue

(10) Patent No.: US 12,766,594 B2
(45) Date of Patent: Oct. 20, 2026

(54) TITANIUM POROUS BODY, AND METHOD FOR PRODUCING TITANIUM POROUS BODY

(71) Applicant: Toho Titanium Co., Ltd., Kanagawa (JP)

(72) Inventor: Yosuke Inoue, Kanagawa (JP)

(73) Assignee: Toho Titanium Co., Ltd., Kanagawa (JP)

( * ) Notice: Subject to any disclaimer, the term of this patent is extended or adjusted under 35 U.S.C. 154(b) by 0 days.

(21) Appl. No.: 18/730,840

(22) PCT Filed: Dec. 27, 2022

(86) PCT No.: PCT/JP2022/048426

§ 371 (c)(1),
(2) Date: Jul. 22, 2024

(87) PCT Pub. No.: WO2023/145374

PCT Pub. Date: Aug. 3, 2023

(65) Prior Publication Data

US 2025/0100048 A1 Mar. 27, 2025

(30) Foreign Application Priority Data

Jan. 31, 2022 (JP) ..... 2022-012822

(51) Int. Cl.
*B32B 5/18* (2006.01)
*B22F 3/11* (2006.01)
*C22C 14/00* (2006.01)

(52) U.S. Cl.
CPC ..... *B22F 3/11* (2013.01); *C22C 14/00* (2013.01); *B22F 2301/205* (2013.01); *B22F 2304/10* (2013.01)

(58) Field of Classification Search
None
See application file for complete search history.

(56) References Cited

U.S. PATENT DOCUMENTS

| | | | | |
|---|---|---|---|---|
| 8,921,689 | B2 * | 12/2014 | Kohno | H01G 9/2022 136/263 |
| 2016/0332233 | A1 * | 11/2016 | Kondoh | C22F 1/02 |
| 2017/0233850 | A1 * | 8/2017 | Shirai | B21B 3/00 428/550 |
| 2023/0311205 | A1 * | 10/2023 | Inoue | B22F 5/006 428/613 |

FOREIGN PATENT DOCUMENTS

| | | | | |
|---|---|---|---|---|
| EP | 4112207 | A1 | 1/2023 | |
| JP | 2011099146 | A * | 5/2011 | |
| JP | 2014-065968 | A | 4/2014 | |
| JP | 2014-239023 | A | 12/2014 | |
| JP | 2021-134396 | A | 9/2021 | |
| WO | WO-2022064898 | A1 * | 3/2022 | B22F 1/052 |

OTHER PUBLICATIONS

Wada et al., machine translation of JP 2011-99146, May 19, 2011 (Year: 2011).*
International Preliminary Report on Patentability in International Application No. PCT/JP2022/048426 dated Aug. 6, 2024, 4 pages.
Search Report in International Application No. PCT/JP2022/048426 dated Mar. 14, 2023, 4 pages.

* cited by examiner

*Primary Examiner* — Mary I Omori
(74) *Attorney, Agent, or Firm* — MARSHALL, GERSTEIN & BORUN LLP

(57) ABSTRACT

The titanium porous body according to the present invention is in a form of a sheet, and has a titanium content of 97% by mass or more, an oxygen content of 0.9% by mass or more and 2.0% by mass or less, and a carbon content of 0.01% by mass or more and 0.06% by mass or less, and has a thickness of 0.3 mm or less, a porosity of 35% or more and 45% or less, an irreversible deformation amount after being pressurized at 65 MPa of 5.0% or less, and a bending strain at break of 0.005 or more.

9 Claims, No Drawings

TITANIUM POROUS BODY, AND METHOD FOR PRODUCING TITANIUM POROUS BODY

TECHNICAL FIELD

The present invention relates to a titanium porous body in a form of a sheet, and a method for producing the titanium porous body.

BACKGROUND ART

Conventional methods for producing titanium porous bodies are disclosed, for example, in Patent Literatures 1 and 2.

Patent Literature 1 discloses:

"A method for producing a porous titanium sintered body, comprising: a slurry preparing step of mixing at least one of titanium powder and titanium hydride powder with an organic binder, a foaming agent, a plasticizer, water, and optionally a surfactant to prepare a slurry; a molding step of applying the slurry onto a first support to form a molded body; a foaming step of foaming the molded body by heating and drying to form a foam molded body; a degreasing step of heating and degreasing the foamed molded body separated from the first support and placed on a second support; a first sintering step of heating the degreased foamed molded body in a non-oxidizing atmosphere to prepare a primary sintered body having electrical conductivity; and a second sintering step of sintering the primary sintered body in a non-oxidizing atmosphere at a temperature higher than that of the first sintering step to prepare a porous titanium sintered body".

Patent Literature 2 discloses:

"A sheet-shaped porous body was obtained by forming titanium hydride powder and titanium powder into a paste, then coating the paste onto a polymer film, and then performing a binder removal treatment, a hydrogen removal treatment and a sintering treatment". For the binder removal treatment, it discloses:

"The dried molded body was sintered in a reduced pressure atmosphere. The details are as follows: heating rate: 3° C./min (room temperature to 300° C.); atmosphere: argon gas; firing temperature: 300° C.; firing time: 2 hours; vacuum sintering furnace: vacuum annealing furnace from Shimadzu Industrial Systems".

CITATION LIST

Patent Literature

[PTL 1]
Japanese Patent Application Publication No. 2009-102701 A

[PTL 2]
Japanese Patent Application Publication No. 2014-109049 A

SUMMARY OF INVENTION

Technical Problem

By the way, a titanium porous body has air and liquid permeability due to its numerous pores, and electrical conductivity, as well as high corrosion resistance due to formation of a passive film on its surface. Therefore, the use of the titanium porous body as a PTL (Porous Transport Layer) in an environment where corrosion may occur in a PEM water electrolytic device is under consideration.

In such an application, the titanium porous body may further be required to have excellent compression resistance. There is a concern that a titanium porous body having poor compression resistance may not be able to maintain the required thickness or shape for the compressive forces that may act when it is incorporated into a device such as a PEM water electrolysis device. In addition, from the viewpoint of miniaturization of the device, thinner sheet-shaped titanium porous bodies are required. However, thinner porous titanium bodies that have been designed to have increased strength in order to improve compression resistance tend to be easily cracked during handling, such as during transporting the porous titanium bodies or when attaching them to equipment.

The production methods using the titanium powder paste as described in Patent Literatures 1 and 2 are advantageous in that they can produce a titanium porous body that has relatively good air and liquid permeability even if it is thinner. On the other hand, there is still room for improvement of the titanium porous bodies produced by the methods described in Patent Literatures 1 and 2 in terms of improvement of compression resistance and prevention of breakage during handling.

An object of the present invention is to provide a titanium porous body in a form of a relatively thin sheet, which has excellent compression resistance, and can prevent breakage during handling, and to provide a method for producing a titanium porous body.

Solution to Problem

As a result of extensive studies, the present inventors have found that a titanium porous body that has excellent compression resistance and is difficult to be broken during handling is obtained by not containing water or a foaming agent in the paste, and by carrying out preheating for volatilizing organic substances such as organic binders under certain temperature and certain time conditions in an oxygen-containing atmosphere.

It is presumed that by making the paste free of water and a foaming agent, the titanium powder is properly dispersed in the paste, so that large voids caused by the water and the foaming agent are not locally formed. As a result, the titanium porous body would have improved compression resistance and would be difficult to be broken during handling. Also, if the paste is dried to obtain a molded body in a form of a sheet, which is then preheated in an oxygen-containing atmosphere, then a surface oxide layer of a certain thickness would be formed on the titanium powder particles, and the oxygen from the surface oxide layer would enter the interiors of the particles during the subsequent sintering, so that the compression resistance would be further improved by solid solution strengthening. In addition, if the amount of oxygen that enters the interiors of the particles is excessive, there is a concern that the produced titanium porous body will become brittle, but it is believed that if the oxygen content is set to a predetermined amount with an appropriate entered amount, the brittle breakage can be suppressed and the suppression of breakage can be achieved. As a result, it is presumed that the titanium porous body has excellent compression resistance and is difficult to be broken.

Here, it is believed that after the paste is prepared, it is dried and formed into a molded body in a form of a sheet, which is then preheated in an oxygen-containing atmosphere, whereby the surface of the titanium powder is oxidized while maintaining the appropriate arrangement of the titanium powder in the paste. If the surface of the titanium powder is previously oxidized before preparing the paste, there is a concern that the oxidized surface layer of the titanium powder will affect the dispersibility of the titanium powder in the paste when the paste is prepared, causing the titanium powder to be unevenly positioned in one area.

However, this invention is not limited to the theory described above.

The titanium porous body according to the present invention is in a form of a sheet, and has a titanium content of 97% by mass or more, an oxygen content of 0.9% by mass or more and 2.0% by mass or less, and a carbon content of 0.01% by mass or more and 0.06% by mass or less, and has a thickness of 0.3 mm or less, a porosity of 35% or more and 45% or less, an irreversible deformation amount after being pressurized at 65 MPa of 5.0% or less, and a bending strain at break of 0.005 or more.

The titanium porous body may have a nitrogen content of 0.01% by mass or more and 0.10% by mass or less.

The titanium porous body may have a thickness of 0.04 mm or more and 0.3 mm or less.

It is preferable that the titanium porous body described above have an irreversible deformation amount after being pressurized at 65 MPa of 3.0% or less.

It is preferable that the titanium porous body as described above has an oxygen content of 1.3% by mass or more and 2.0% by mass or less.

It is preferable that the titanium porous body as described above has a bending strain at break of 0.007 or more.

The method for producing a titanium porous body according to the present invention is a method for producing a titanium porous body in a form of a sheet, the method comprising: a drying step of drying a paste containing titanium powder, an organic binder, and an organic solvent but not containing water or a foaming agent on a resin substrate to obtain a molded body in a form of a sheet; a preheating step of heating the molded body in an oxygen-containing atmosphere at a temperature of more than 350° C. and less than 450° C. for a period of time of 3 hours or more and 12 hours or less to volatilize organic substances in the molded body; and a sintering step of heating the molded body after the preheating step to sinter the titanium powder in the molded body.

It is preferable to use as the titanium powder a pulverized powder having an average particle size D50 of 10 μm or more and 20 μm or less.

The titanium powder preferably has a titanium content of 99% by mass or more and an oxygen content of 0.7% by mass or less.

In the sintering step, the molded body is preferably heated at a temperature of 700° C. or more and 850° C. or less for a period of time of 1 hour or more and 4 hours or less.

Advantageous Effects of Invention

The titanium porous body according to the present invention is in a form of a relatively thin sheet, has excellent compression resistance, and has suppressed breakage during handling. The method for producing a titanium porous body according to the present invention is suitable for producing such a titanium porous body.

DESCRIPTION OF EMBODIMENTS

Embodiments of the present invention will be described in detail below.

The titanium porous body according to an embodiment of the present invention is in a form of a sheet and has a thickness of 0.3 mm or less, the titanium porous body having: a titanium content of 97% by mass or more, an oxygen content of 0.9% by mass or more and 2.0% by mass or less, and a carbon content of 0.01% by mass or more and 0.06% by mass or less. The titanium porous body has a porosity of 35% or more and 45% or less, an irreversible deformation amount after being pressurized at 65 MPa of 5.0% or less, and a bending strain at break of 0.005 or more. Such a titanium porous body has excellent compression resistance and is difficult to be broken during handling, despite its relatively low thickness. Since the titanium porous body has excellent compression resistance, it is difficult to be compression-deformed, and it is also difficult to be broken even if bending stress occurs, leading to easy handling. For example, when such a titanium porous body is incorporated into a device such as a PEM water electrolysis device, it easily maintains a required thickness or shape, and is difficult to be broken during the assembling operation of the device such as a PEM water electrolysis device.

To produce the titanium porous body, the following steps are performed: a drying step of drying a paste containing titanium powder on a resin substrate to obtain a molded body in a form of a sheet; a preheating step of heating the molded body to volatilize organic substances in the molded body; and subsequently, a sintering step of heating the molded body to sinter the titanium powder in the molded body. Before the drying step, a paste application step may be performed to apply the paste onto the resin substrate.

The paste contains the titanium powder, an organic binder, and an organic solvent, but it does not contain water or a foaming agent. If the paste contains the foaming agent, larger voids may be locally formed due to the foaming of the foaming agent, but in this embodiment, the paste does not contain the foaming agent, so that the local formation of such larger voids is suppressed. Further, wettability of water between the titanium powder and the resin substrate is different from that of the organic solvent, and the organic solvent tend to dry easily, but water tends to be difficult to dry. Therefore, if water is contained in addition to the organic solvent, it is difficult to obtain any uniform paste, and furthermore, due to the influence of the difference of wettability, the titanium powder varies during drying, so that the larger voids are easily formed locally in the molded body after drying. If a paste that does not contain water is used, the formation of such voids is suppressed.

Further, it is believed that by carrying out the preheating step in the oxygen-containing atmosphere, a relatively thick surface oxide layer is formed on each of the titanium powder particles when the organic substances are volatilized and removed. Then, in the subsequent sintering step, it is presumed that the oxygen in the surface oxide layer of the titanium powder particles will be in solid solution therein, thereby strengthening the titanium porous body as a sintered body.

As a result, the titanium porous body is produced which has excellent compression resistance and is difficult to be cracked when handling.

(Composition)

The titanium porous body is made of titanium. If it is made of titanium, a titanium porous body having high electrical conductivity can be obtained with a certain relative density. The titanium content of the titanium porous body is 97% by mass or more, preferably 98% by mass or more. The upper limit of the titanium content may be, for example, 99.8% by mass or less, or 99% by mass or less or less, although not particularly limited thereto.

The titanium porous body may contain Fe as an impurity, with an Fe content of 0.25% by mass or less, for example. The titanium porous body may also contain Ni, Cr, Al, Cu, Zn, and Sn as unavoidable impurities resulting from the production process, for example. It is suitable that the content of each of Ni, Cr, Al, Cu, Zn, and Sn is less than 0.10% by mass, and the total content thereof is preferably less than 0.30% by mass.

The titanium porous body may, for example, have an oxygen content of 0.9% by mass or more and 2.0% by mass or less. If the oxygen content is 0.9% by mass or more, the strength is high and the required compression resistance is obtained. The oxygen content is preferably 1.3% by mass or more. Furthermore, if the oxygen content is 2.0% by mass or less, the titanium porous body is prevented from becoming more brittle, so that it is difficult to be broken during handling. That is, although other conditions such as porosity may also be affected, such control of the oxygen content easily achieves both the compression resistance and the bending strain at break at higher levels. From this viewpoint, the oxygen content is preferably 1.3% by mass or more and 2.0% by mass or less. The oxygen content can be measured by an inert gas fusion-infrared absorption method.

When the titanium porous body according to this embodiment is produced using a paste containing titanium powder as described below, carbon in the organic substances contained in the paste may remain, resulting in a relatively high carbon content. Specifically, the carbon content of the titanium porous body may be 0.01% by mass or more and 0.06% by mass or less, and typically 0.01% by mass or more and 0.04% by mass or less. The carbon content can be measured by a combustion infrared absorption method.

The nitrogen content of the titanium porous body may vary depending on the production conditions, but it may be, for example, 0.01% by mass or more and 0.10% by mass or less, typically 0.05% by mass or more and 0.10% by mass or less. For example, when heating is performed in an air atmosphere in the preheating step of the production method described below, the nitrogen content of the titanium porous body may be in the above range. The nitrogen content can be measured by an inert gas fusion-thermal conductivity method.

The titanium porous body may have a purity corresponding to pure titanium types 1-4 in JIS H 4600 (2012), typically type 1 or 2, except for the oxygen content and the nitrogen content as described above.

(Thickness)

The titanium porous body in the form of the sheet has a thickness of 0.3 mm or less, or it may be 0.04 mm or more and 0.3 mm or less, or it may be 0.04 mm or more and 0.2 mm or less. Depending on the application, such a lower thickness may be required. It should be noted that the term "form of a sheet" for the titanium porous body means a plate shape or a foil shape having a smaller thickness with respect to planar view dimensions, and there is no particular limitation on the shape in the planar view.

The thickness is measured at five points in total: four at the periphery and one at the center of the titanium porous body, using a digital thickness gage having a flat measuring element of 10 mm in diameter and a measurement accuracy of 0.001 to 0.01 mm, such as Mitutoyo's digital thickness gage (Model No. 547-321), for example. An average of these measurements is used as an average value. If the titanium porous body in the form of the sheet is rectangular in the planar view, the above four points of the periphery should be the four points of the four corners.

(Porosity)

The porosity of the titanium porous body is preferably 35% or more and 45% or less. The porosity in such a range can exert a high compression resistance while ensuring the required air permeability or liquid permeability depending on the application, and can suppress cracking during handling. If the porosity is less than 35%, the desired air or liquid permeability may not be obtained. On the other hand, if the porosity is more than 45%, there is a concern that the compression resistance may decrease and cracks may easily occur during handling.

A porosity $\varepsilon$ of the titanium porous body is calculated using a volume calculated from the width, length and thickness of the titanium porous body and an apparent density $\rho'$ calculated from the mass, and a true density $\rho$ (4.51 g/cm$^3$) of the titanium that makes up the titanium porous body, according to the equation: $\varepsilon=(1-\rho'/\rho)\times 100$.

When the titanium porous body is produced using titanium powder as described below, the skeleton of the three-dimensional network structure that defines the voids of the titanium porous body tends to be sponge titanium-shaped. The skeleton of the sponge titanium-shaped three-dimensional network structure is similar to the shape of the sponge titanium produced by the Kroll process. On the other hand, when titanium fibers are used, the skeleton of the three-dimensional network structure that defines the voids of the titanium porous body is often in a nonwoven shape. Further, in the method of using a paste containing titanium powder and organic binder, etc., drying the paste and then sintering the titanium powder, if the paste contains a foaming agent, the titanium porous body thus produced is susceptible to the formation of voids even within the skeleton due to the effect of the foaming agent.

(Irreversible Deformation Amount)

When the titanium porous body is subjected to the following operation twice: compressing it by applying a pressure of 65 MPa in the thickness direction for 3 minutes and then unloading it, the irreversible deformation amount, which is a ratio of changes in thicknesses before and after the operations, is 5.0% or less.

As a result, when the titanium porous body is incorporated into a device such as a PEM water electrolysis device, it can maintain the required thickness or shape when a compressive force is applied. The irreversible deformation amount is preferably 3.0% or less. Although a smaller irreversible deformation amount is more preferred, it may be, for example, 0.6% or more. The irreversible deformation amount may be, for example, 0.6% or more and 5.0% or less, or it may be, for example, 0.6% or more and 3.0% or less.

More specifically, the irreversible deformation amount Dc is a value calculated by measuring a thickness T1 of the titanium porous body before applying a pressure of 65 MPa and a thickness T2 of the titanium porous body after applying and releasing the pressure, according to the equation: $Dc=(1-T2/T1)\times 100$.

To measure the irreversible deformation amount Dc, the thickness T1 of the titanium porous body is previously measured. The titanium porous body is sandwiched between flat surfaces of two flat plates or the like in the thickness direction, and the flat surfaces are displaced in a direction that brings them closer to each other, thereby evenly applying a pressure of 65 MPa to the surface of the titanium porous body in the thickness direction for three minutes. After applying the pressure, the pressure is released. This operation of applying and releasing the pressure is performed again, so that such an operation is performed twice in total. The thickness T2 of the titanium porous body removed from the space between the flat surfaces is then measured. Here, various compression test devices and other devices capable of applying a pressure to the titanium porous body in this way can be used. To measure the thicknesses T1 and T2 of the titanium porous body, the thickness is measured at five different positions in a planar view of the titanium porous body (for example, if the titanium porous body is rectangular in a planar view, the thickness is measured at five positions in total: the center and the four surrounding corners), and an average values of these measurements are determined to be the thicknesses T1 and T2.

(Bending Strain at Break)

The bending strain at break of the titanium porous body is 0.005 or more. If the bending strain at break is larger, it can be said that the titanium porous body is difficult to be broken and has excellent handling properties. Therefore, it is preferable that the bending strain at break is larger, for example, 0.007 or more. On the other hand, as shown in the example section below, there are titanium porous bodies that are not broken even if the bending strain is larger to a certain extent. Therefore, the upper limit of the bending strain at break is not particularly limited. To give an example, the bending strain at break may be, for example, 0.10 or less. The bending strain at break may be, for example, 0.005 or more and 0.10 or less, or, for example, 0.007 or more and 0.10 or less.

The bending strain at break of the titanium porous body is measured by a three-point bending test. The specimen has dimensions: a length of 60 mm, a width of 15 mm, a distance between supports of 22.5 mm, a diameter of 5 mm of each of an indenter and the support, and a test rate of 2 mm/min. Other conditions are in accordance with JIS K 7171 (How to determine bending properties of plastics). the bending strain $\varepsilon_f$ is calculated by the equation: $\varepsilon_f=6\ sh/L^2$ in which s is deflection (mm), h is a thickness of the specimen (mm), and L is a distance between supports (mm). The bending strain at break is the bending strain when the specimen is broken. The measuring device that can be used is, for example, Techno Graph TG-1KN from Minebea.

(Production Method)

The above titanium porous body may be produced, for example, as described below.

First, a paste containing titanium powder, an organic binder, and an organic solvent is prepared. The paste does not contain water or a foaming agent. It is presumed that the absence of water and a foaming agent in the paste prevents local large voids caused by foaming of the foaming agent from being formed in the titanium porous body, and resistance to compression is increased, and it is difficult to be cracked during handling. Also, wettability of water between the titanium powder and the resin substrate is different from that of the organic solvent, and ease of drying of water is also different from that of the organic solvents. Therefore, if the paste contains not only the organic solvent but also water, a homogeneous paste cannot be obtained, and the titanium powder will vary in the paste during drying, making it easier for larger voids to be formed in the molded body after drying. Therefore, it may not be possible to produce the desired titanium porous body.

Various titanium powders can be used as the titanium powder to be contained in the paste, but when a pulverized powder such as hydride-dehydride titanium powder (so-called HDH powder) is used as the titanium powder, the number of contact points between the particles making up the pulverized powder increases, which is preferable in that the compression resistance is further improved. It should be noted that the hydride-dehydride titanium powder refers to a powder obtained by hydrogenating sponge titanium, pulverizing it, and then dehydrogenating the resulting powder. Titanium powder, including the above hydride-dehydride titanium powder, may contain 0.5% by mass or less of hydrogen. Also, the titanium powder may have a hydrogen content of 0.1% by mass or less.

The titanium powder preferably has an average particle size D50 of 10 μm or more and 20 μm or less. The production of the titanium porous body using such fine titanium powder will result in a titanium porous body having a lower thickness, a porosity in the desirable range, improved compression resistance and difficulty to be broken during handling. The average particle size D50 means the particle size at which the cumulative distribution on a volume basis is 50% in the particle size distribution obtained by the laser diffraction scattering method.

The titanium powder preferably has a titanium content of 99% by mass or more and an oxygen content of 0.7% by mass or less. The oxygen content may be 0.1% by mass or more. The oxygen content of the titanium powder may be 0.1% by mass or more and 0.7% by mass or less, and titanium powder having an oxygen content of 0.1% by mass or more and 0.6% by mass or less may be used. If titanium oxide powder having a higher oxygen content is used as the titanium powder, there is a risk that the titanium powder will not be uniformly dispersed in the paste due to a change in dispersibility based on a change in surface properties.

The organic binder and the organic solvent used in the paste can be appropriately selected from various substances. For example, the organic binder can be methyl cellulose-based, polyvinyl alcohol-based, ethyl cellulose-based, acrylic, polyvinyl butyral-based solvents, and the like. The organic solvent can be alcohol (ethanol, isopropyl alcohol, terpineol, butyl carbitol, etc.), toluene, cyclohexane, methyl ethyl ketone, and the like. However, they are not limited to the above-listed substances. As an example, the organic binder can be polyvinyl butyral and the organic solvent can be isopropyl alcohol. The paste may further contain a plasticizer (glycerin, ethylene glycol, or the like) and a surfactant (alkylbenzene sulfonate, or the like).

The mass ratio of the titanium powder to the organic substances including the organic binder and the organic solvent can be appropriately set, and is preferably set to the range of, for example, titanium powder:organic substances=1:1 to 4:1. This allows the porosity of the titanium porous body to be controlled to the appropriate range. For example, the amount of the organic binder may be 5 g to 15 g and the amount of the organic solvent may be 25 g to 45 g, per 100 g of titanium powder.

The paste can be prepared by mixing the titanium powder, the organic binder, the organic solvent, and the like as described above, using, for example, a mixer with an agitator, a rotary mixer, a triple roll mill, and the like. At this time, the mixture may be pulverized using a vibration mill, a bead mill, or other pulverizing mixers.

In the paste application step, the above paste is relatively thinly applied onto a resin substrate. The resin substrate is relatively inexpensive and flexible, and is easily handled. Specific materials for the resin substrate include polyesters such as PET (polyethylene terephthalate) and PEN (polyethylene naphthalate), and polyvinyls such as polyethylene, polypropylene, polystyrene, and polyvinyl alcohol, among which PET is inexpensive and preferable.

In the drying step, the paste is dried on the resin substrate in, for example, an oven, a dryer or the like. This causes the organic solvent in the paste to evaporate, and provides a molded body in a form of a sheet.

Drying conditions such as a temperature and a time can be appropriately set, and, for example, the temperature can be 80° C. to 160° C., and the drying time can be 5 minutes to 20 minutes. From the viewpoint of effectively removing the organic solvent from the paste, it is desirable to perform the drying while evacuating a gas from the furnace. When evacuating the interior of the furnace, the interior of the furnace can in a reduced pressure atmosphere, or can have the same pressure as the outside pressure by feeding a gas such as the air atmosphere.

After the drying step, the molded body obtained by drying the paste is released from the resin substrate and subjected to the next preheating step. When the resin substrate as described above is used, the molded body can be easily released from the resin substrate. By releasing the molded body from the resin substrate at this stage, it is possible to prevent the inclusion of carbon derived from the resin substrate in the subsequent preheating step and sintering step, and the resulting unintended increase in the carbon content.

Next, in a preheating step, the molded body is heated in a furnace to volatilize and remove the organic substances such as the organic binder in the molded body. Here, the heating is carried out in an oxygen-containing atmosphere at a temperature of more than 350° C. and less than 450° C. for a period of time of 3 hours to 12 hours.

By carrying out the preheating step in the oxygen-containing atmosphere, the surfaces of the particles making up the titanium powder in the molded body are oxidized to form a surface oxide layer. By forming the surface oxide layer at this time, the oxygen from the surface oxide layer enters the interiors of the titanium powder particles in the subsequent sintering step, resulting in solid solution and strengthening of the titanium porous body of the sintered body.

The atmosphere in the preheating step is not particularly limited as long as it contains oxygen, but the air atmosphere is preferable. This is because the air atmosphere can be easily created without using a special furnace. When an atmosphere containing not only oxygen but also nitrogen is used, such as the air atmosphere, the nitrogen content of the titanium porous body may increase to some extent. The oxygen concentration in the atmosphere can be, for example, 10% by volume or more and 100% by volume or less.

In the preheating step, the heating temperature is more than 350° C. and less than 450° C., and the molded body is heated at that temperature for 3 hours or more and 12 hours or less. It is believed that a relatively thick surface oxide layer is formed on the properly arranged titanium particles in the molded body. Such a surface oxide layer can contribute to improvement of the compression resistance of the titanium porous body. In the preheating step, the heating temperature may be, for example, 360° C. or more and 430° C. or less, or, for example, 360° C. or more and 410° C. or less. In the preheating step, the heating time may be, for example, 3 hours or more and 10 hours or less, or, for example, 4 hours or more and 10 hours or less, or further, 5 hours or more and 10 hours or less.

If the heating temperature is too low or the heating time is too short, it is not sufficient to form the surface oxide layer, so that the compression resistance of the titanium porous body may not be significantly improved. On the other hand, if the heating temperature is too high or the heating time is too long, the amount of oxygen will be too large, so that the produced titanium porous body may become highly brittle.

The molded body that has been subjected to the preheating step is then subjected to a sintering step to sinter the titanium powder in the molded body. At this time, it is believed that the particles of the titanium powder lead to solid solution strengthening by the oxygen in the surface oxide layer formed on the particles in the preheating step. As a result, the compression resistance of the titanium porous body obtained after the sintering step is significantly improved.

The conditions of the sintering step are not particularly limited as long as the titanium powder in the molded body is sintered. For example, in the sintering step, the molded body may be heated at a temperature of 700° C. or more and 850° C. or less for a period time of 1 hour to 4 hours. Since the titanium porous body according to this embodiment is relatively thin, the titanium powder can be appropriately sintered by heating at a relatively low temperature for a short period of time. The atmosphere during sintering may be, for example, a vacuum of $1.0\times10^{-2}$ Pa or less, or an inert atmosphere of an Ar gas or a He gas.

After the sintering step, the titanium porous body is obtained. As described above, the titanium porous body is in the form of the relatively thin sheet, has excellent compression resistance, and can suppress cracking during handling.

EXAMPLES

Next, the titanium porous body according to the present invention was experimentally produced, and its performance was evaluated as described below. However, descriptions herein are merely for illustration, and are not intended to be limited thereto.

As the titanium powder, HDH powder having a titanium content of 99% by mass or more, a hydrogen content of 0.05% by mass or less, an oxygen content of about 0.4% by mass, and an average particle size D50 of 13.5 μm was used to prepare a paste. In addition to the titanium powder, the paste contained polyvinyl butyral as an organic binder and isopropyl alcohol as an organic solvent. The paste contained the respective components in a ratio of 9 g of organic binder and 36 g of organic solvent per 100 g of titanium powder. As described above, the paste did not contain water or a foaming agent.

The paste was applied onto a resin substrate made of PET, and the paste on the resin substrate was dried at 120° C. for 10 minutes to obtain a molded body in a form of a sheet. Furthermore, an attempt was made to produce a molded body using a paste in which the organic solvent was reduced by 10% by mass and 10% of water was added, but the paste was not uniform and a good molded body could not be produced.

The molded body was then preheated in the air atmosphere under the conditions shown in Table 1. The molded body was then heated in a vacuum atmosphere of $1.0\times10^{-2}$ Pa or less at 800° C. for 2 hours to sinter the titanium powder in the molded body, thereby obtaining a titanium porous body as a sintered body.

The components (oxygen content, nitrogen content, and carbon content), the thickness, the porosity, the bending strain at break, and the irreversible deformation amount for each titanium porous body were confirmed by the methods described above, and the results are shown in Table 1. The titanium content of each of the titanium porous bodies according to Examples 1 to 6 was 98% by mass or more.

TABLE 1

| | Preheating | | | Components | | | | Three-Point Bending Test | | Compression Test Irreversible Deformation |
|---|---|---|---|---|---|---|---|---|---|---|
| | Temperature, Time | Atmosphere | Thickness (mm) | O (mass %) | N (mass %) | C (mass %) | Porosity (%) | Presence or Absence of Breakage | Bending Strain at Break (—) | Amount after 65 MPa Pressurizing (%) |
| Example 1 | 380° C., 4 h | Air | 0.046 | 0.9 | 0.05 | 0.03 | 45 | Absent | No Brekage at 0.006 or more | 2.3 |
| Example 2 | 380° C., 8 h | Air | 0.098 | 1.6 | 0.08 | 0.02 | 40 | Absent | No Breakage at 0.009 or more | 1.4 |
| Example 3 | 380° C., 8 h | Air | 0.117 | 1.5 | 0.06 | 0.04 | 44 | Present | 0.0086 | 1.5 |
| Example 4 | 380° C., 8 h | Air | 0.174 | 1.7 | 0.09 | 0.03 | 42 | Present | 0.0070 | 1.3 |
| Example 5 | 360° C., 4 h | Air | 0.046 | 0.9 | 0.03 | 0.05 | 45 | Absent | No Breakage at 0.006 or more | 3.6 |
| Example 6 | 380° C., 10 h | Air | 0.046 | 1.8 | 0.09 | 0.02 | 45 | Present | 0.0063 | 1.4 |
| Comp. 1 | 300° C., 4 h | Air | 0.046 | 0.6 | 0.03 | 0.08 | 42 | Absent | No Breakage at 0.006 or more | 7.1 |
| Comp. 2 | 300° C., 8 h | Air | 0.175 | 0.7 | 0.03 | 0.09 | 42 | Present | 0.011 | 5.6 |
| Comp. 3 | 450° C., 4 h | Air | 0.046 | 2.5 | 0.13 | 0.02 | 42 | Present | 0.0043 | 2.1 |
| Comp. 4 | 450° C., 8 h | Air | 0.175 | 2.8 | 0.14 | 0.02 | 42 | Present | 0.0037 | 1.4 |
| Comp. 5 | 380° C., 2 h | Air | 0.175 | 0.7 | 0.08 | 0.04 | 42 | Present | 0.0075 | 6.1 |
| Comp. 6 | 380° C., 4 h | Argon | 0.175 | 0.6 | 0.02 | 0.15 | 42 | Present | 0.0042 | 5.9 |

As can be seen from Table 1, all of the porous titanium bodies according to Examples 1 to 6 had excellent compression resistance because the irreversible deformation amount was lower, and were difficult to be cracked during handling because the bending strain at break was higher.

In Comparative Examples 1 and 2, the oxygen content of each titanium porous body was lower and the irreversible deformation amount was higher because of the lower preheating temperature. The titanium porous bodies according to Comparative Examples 1 and 2 also had high carbon contents. This indicates that the binder was not sufficiently removed by preheating.

In Comparative Examples 3 and 4, the oxygen content in each titanium porous body was too high, resulting in a lower bending strain at brake, because the preheating was performed at the higher temperature.

In Comparative Example 5, due to the shorter preheating time, the oxygen content in the titanium porous body was lower and the solid-solution strengthening by oxygen was not sufficient, so that the irreversible deformation amount would be higher. In Comparative Example 6, the oxygen content in the titanium porous body was lower, resulting in the larger irreversible deformation amount, because the preheating was performed in the argon atmosphere. The bending strain at break was also lower.

In view of the foregoing, it was found that according to the present invention, it is possible to obtain a titanium porous body in a relatively thin sheet form that has excellent compression resistance and can control the breakage during handling.

The invention claimed is:

1. A titanium porous body in a form of a sheet, wherein:

the titanium porous body has a titanium content of 97% by mass or more, an oxygen content of 0.9% by mass or more and 2.0% by mass or less, a carbon content of 0.01% by mass or more and 0.06% by mass or less, and a nitrogen content of 0.05% by mass or more and 0.10% by mass or less; and, the titanium porous body has:

a thickness of 0.3 mm or less;

a porosity of 35% or more and 45% or less;

an irreversible deformation amount after being pressurized at 65 MPa of 5.0% or less, and a bending strain at break of 0.005 or more.

2. The titanium porous body according to claim 1, wherein the thickness is 0.04 mm or more and 0.3 mm or less.

3. The titanium porous body according to claim 1, wherein the irreversible deformation amount after being pressurized at 65 MPa is 3.0% or less.

4. The titanium porous body according to claim 1, wherein the oxygen content is 1.3% by mass or more and 2.0% by mass or less.

5. The titanium porous body according to claim 1, wherein the bending strain at break is 0.007 or more.

6. The titanium porous body according to claim 1, wherein the titanium porous body has an Fe content of 0.25% by mass or less.

7. The titanium porous body according to claim 1, wherein the titanium porous body is a sintered body composed of titanium powder.

8. The titanium porous body according to claim 1, wherein the titanium porous body has a skeleton of sponge titanium-shaped three-dimensional network structure.

9. A titanium porous body in a form of a sheet, wherein:

the titanium porous body has a titanium content of 97% by mass or more, an oxygen content of 0.9% by mass or more and 2.0% by mass or less, a carbon content of 0.01% by mass or more and 0.06% by mass or less, and a nitrogen content of 0.05% by mass or more and 0.10% by mass or less; and, the titanium porous body has:

a thickness of 0.3 mm or less;

a porosity of 35% or more and 45% or less; and, an irreversible deformation amount after being pressurized at 65 MPa of 5.0% or less, and a bending strain at break of 0.005 or more, the titanium porous body being produced in the form of the sheet by a method comprising:

a drying step of drying a paste containing titanium powder, an organic binder, and an organic solvent but not containing water or a foaming agent on a resin substrate to obtain a molded body in a form of a sheet;

a preheating step of heating the molded body in an oxygen-containing atmosphere at a temperature of more than 350° C. and less than 450° C. for a period of time of 3 hours or more and 12 hours or less to volatilize organic substances in the molded body; and a sintering step of heating the molded body after the preheating step to sinter the titanium powder in the molded body.

* * * * *